US011693362B2

(12) United States Patent
Takagi et al.

(10) Patent No.: US 11,693,362 B2
(45) Date of Patent: Jul. 4, 2023

(54) IMAGE FORMING APPARATUS

(71) Applicants: Hiromasa Takagi, Tokyo (JP); Seiji Saitoh, Kanagawa (JP); Jun Okamoto, Tokyo (JP); Tamotsu Ikeda, Tokyo (JP); Yoshikuni Sasaki, Kanagawa (JP); Takahiro Imada, Kanagawa (JP)

(72) Inventors: Hiromasa Takagi, Tokyo (JP); Seiji Saitoh, Kanagawa (JP); Jun Okamoto, Tokyo (JP); Tamotsu Ikeda, Tokyo (JP); Yoshikuni Sasaki, Kanagawa (JP); Takahiro Imada, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/852,381

(22) Filed: Jun. 29, 2022

(65) Prior Publication Data

US 2023/0008258 A1 Jan. 12, 2023

(30) Foreign Application Priority Data

Jul. 6, 2021 (JP) ..... 2021-112032

(51) Int. Cl.
*G03G 21/20* (2006.01)
*G03G 15/20* (2006.01)
*G03G 15/00* (2006.01)

(52) U.S. Cl.
CPC ..... *G03G 21/206* (2013.01); *G03G 15/2035* (2013.01); *G03G 15/2039* (2013.01);
(Continued)

(58) Field of Classification Search
CPC ..... G03G 21/206; G03G 15/2042; G03G 15/2017; G03G 15/2039
See application file for complete search history.

(56) References Cited

U.S. PATENT DOCUMENTS 6,539,185 B2 * 3/2003 Hanyu ..... G03G 15/2039 399/21
2011/0058863 A1 3/2011 Shinshi et al.
(Continued)

FOREIGN PATENT DOCUMENTS

JP 62-123484 6/1987
JP 2012-118487 6/2012
(Continued)

*Primary Examiner* — Jessica L Eley
(74) *Attorney, Agent, or Firm* — Xsensus LLP

(57) ABSTRACT

An image forming apparatus includes two rotators, a driver driving the rotators, a heating device to heat the rotator, a blower blowing air to the heating device, a temperature detector, a recording medium detector, a cover, an open-close detector, and circuitry. The circuitry detects an abnormal state and stops heat generation, determines whether the cover is closed using the open-close detector, controls the blower to blow air when the cover is closed, determines whether the recording medium is in the nip using the recording medium detector, controls the driver to rotate the two rotators when the cover is closed and no recording medium is in the nip, determines whether a temperature detected is equal to or lower than a threshold value before the cover is opened, and controls the blower to decrease an air volume when the temperature detected is equal to or lower than the threshold value.

7 Claims, 10 Drawing Sheets

(52) U.S. Cl.
CPC ..... *G03G 15/2064* (2013.01); *G03G 15/5008* (2013.01); *G03G 15/5045* (2013.01)

(56) References Cited

U.S. PATENT DOCUMENTS

| | | | | |
|---|---|---|---|---|
| 2012/0195653 | A1 | 8/2012 | Sasaki | |
| 2014/0112680 | A1 | 4/2014 | Ueno et al. | |
| 2015/0261183 | A1 | 9/2015 | Kikushima et al. | |
| 2018/0231927 | A1* | 8/2018 | Kunihisa | H05K 7/20727 |
| 2019/0011879 | A1* | 1/2019 | Miyazaki | G03G 15/2017 |
| 2021/0364962 | A1 | 11/2021 | Ikeda | |
| 2021/0364986 | A1 | 11/2021 | Okamoto | |

FOREIGN PATENT DOCUMENTS

| | | |
|---|---|---|
| JP | 2013-205669 | 10/2013 |
| JP | 2014-238613 | 12/2014 |
| JP | 2015-036743 | 2/2015 |
| JP | 2020-067472 | 4/2020 |

* cited by examiner

IMAGE FORMING APPARATUS

CROSS-REFERENCE TO RELATED APPLICATION

This patent application is based on and claims priority pursuant to 35 U.S.C. § 119(a) to Japanese Patent Application No. 2021-112032, filed on Jul. 6, 2021, in the Japan Patent Office, the entire disclosure of which is hereby incorporated by reference herein.

BACKGROUND

Technical Field

Embodiments of the present disclosure relate to an image forming apparatus.

Related Art

An image forming apparatus such as a copier and a printer includes a fixing device that is one type of heating device. In the fixing device, a sheet is nipped by a pair of rotators such as an endless belt and a roller and heated to fix an image onto the sheet.

SUMMARY

This specification describes an improved image forming apparatus that includes two rotators, a driver, a heating device, a temperature detector, a recording medium detector, a cover, an open-close detector, and circuitry. The two rotators contact each other to form a nip through which a recording medium passes. The driver drives the two rotators. The heating device includes a heater to heat at least one of the two rotators. The blower blows air to the heating device. The temperature detector detects a temperature of at least one of the two rotators. The recording medium detector detects whether the recording medium is in the nip. The cover is disposed on an image forming apparatus body and configured to be openable and closable. The open-close detector detects opening and closing of the cover. The circuitry detects an abnormal state and stops heat generation of the heater in response to detection of the abnormal state, determine whether the cover is closed based on a result detected by the open-close detector, controls the blower to blow air to the heating device in response to determining that the cover is closed, determines whether the recording medium is in the nip based on a result detected by the recording medium detector, controls the driver to rotate the two rotators in response to determining that the cover is closed and determining that no recording medium is in the nip, determines whether a temperature detected by the temperature detector is equal to or lower than a predetermined temperature threshold value before the open-close detector detects that the cover is opened, and controls the blower to decrease an air volume blown by the blower in response to determining that the temperature detected by the temperature detector is equal to or lower than the predetermined temperature threshold value.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
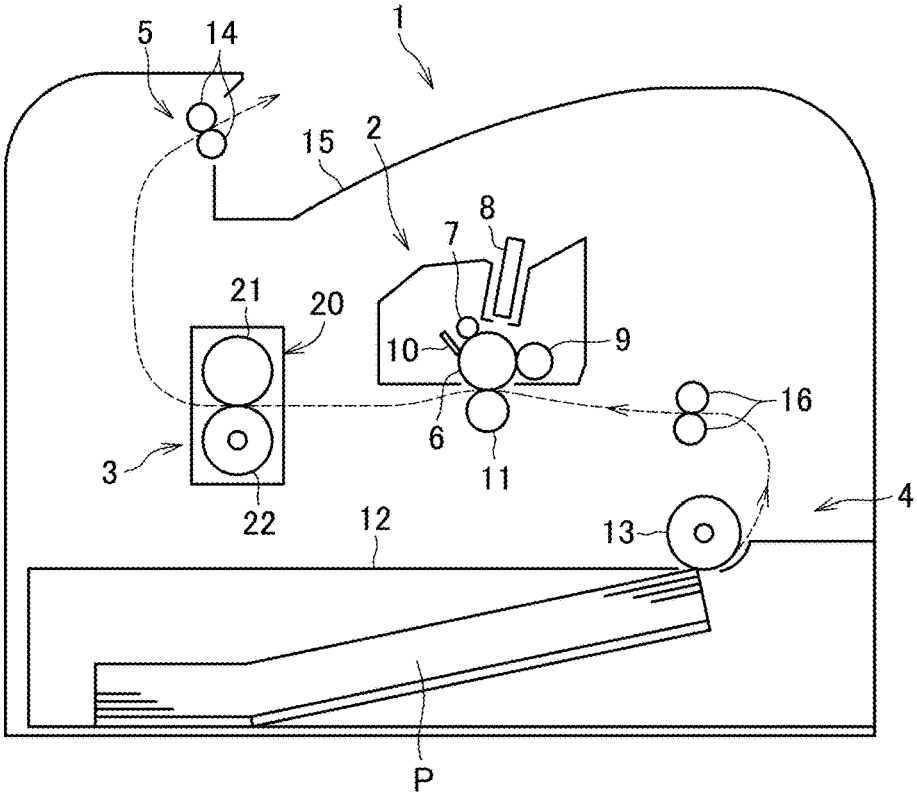
FIG. 1 is a schematic sectional view of an image forming apparatus according to an embodiment of the present disclosure to illustrate a configuration of the image forming apparatus.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise. Identical reference numerals are assigned to identical components or equivalents and a description of those components is simplified or omitted.

FIG. 1 is a schematic sectional view of an image forming apparatus according to an embodiment of the present disclosure to illustrate a configuration of the image forming apparatus. In the present disclosure, the image forming apparatus may be a copier, a facsimile machine, a printer, a plotter, multifunctional machines, or multifunction peripherals having a combination of the copying machine, the facsimile, the printer, and the plotter. The term "image formation" indicates an action for providing (i.e., printing) not only an image having a meaning, such as texts and figures on a recording medium, but also an image having no meaning, such as patterns on the recording medium. Initially, with reference to FIG. 1, a description is given of an overall configuration and operation of an image forming apparatus according to an embodiment of the present disclosure.

As illustrated in FIG. 1, an image forming apparatus 1 according to the present embodiment includes an image forming device 2 to form an image on a sheet-shaped recording medium such as a sheet, a fixing section 3 to fix the image onto the recording medium, a recording medium feeder 4 to feed the recording medium to the image forming device 2, and a recording medium ejection section 5 to eject the recording medium to an outside of the image forming apparatus 1.

The image forming device 2 includes a photoconductor 6 serving as an image bearer to bear an image on the surface of the photoconductor 6, a charger 7 to charge the surface of the photoconductor 6, an exposure unit 8 to form an electrostatic latent image on the surface of the photoconductor 6, a developing roller 9 to supply toner to the electrostatic latent image and form a toner image on the surface of the photoconductor 6, a cleaner 10 to clean the surface of the photoconductor 6, and a transferor 11 to transfer the toner image from the photoconductor 6 to a recording medium.

The fixing section 3 includes a fixing device 20 that fixes the toner image onto the recording medium. The fixing device 20 includes a fixing rotator 21, a heater such as a halogen heater to heat the fixing rotator 21, a pressure rotator 22 that is pressed against the fixing rotator 21. Each of the fixing rotator 21 and the pressure rotator 22 is a rotator such as a roller or an endless belt. The pressure rotator 22 is in contact with the fixing rotator 21 to form a nip.

The recording medium feeder 4 includes a sheet tray 12 to store sheets P as recording media and a feed roller 13 to feed the sheet P from the sheet tray 12. The "recording medium" is described as a "sheet" in the following embodiments but is not limited to the sheet. Examples of the "recording medium" include not only the sheet of paper but also an overhead projector (OHP) transparency sheet, a fabric, a metallic sheet, a plastic film, and a prepreg sheet including carbon fibers previously impregnated with resin. Examples of the "sheet" include thick paper, a postcard, an envelope, thin paper, coated paper (e.g., coat paper and art paper), and tracing paper, in addition to plain paper.

The recording medium ejection section 5 includes an output roller pair 14 to eject the sheet to the outside of the image forming apparatus and an output tray 15 to place the sheet P ejected by the output roller pair 14.

Next, a printing operation of the image forming apparatus 1 according to the present embodiment is described with reference to FIG. 1.

As the start of image forming operation is instructed, in the image forming device 2, the photoconductor 6 starts rotating, and the charger 7 uniformly charges the surface of the photoconductor 6 to a high potential. Next, based on image data of a document read by a scanner or print data transmitted by a terminal device, the exposure unit 8 exposes the surface of the photoconductor 6. Then, the potential of an exposed surface drops, and the electrostatic latent image is formed on the photoconductor 6. The developing roller 9 supplies toner to the electrostatic latent image formed on the photoconductor 6, forming the toner image thereon.

As the photoconductor 6 rotates, the toner image formed on the surface of the photoconductor 6 reaches a transfer nip at which the transferor 11 is in contact with the photoconductor 6, and the transferor 11 transfers the toner image onto the sheet P at the transfer nip. The sheet P is fed from the recording medium feeder 4. In the recording medium feeder 4, the feed roller 13 rotates to feed the sheet P one by one from the sheets stored in the sheet tray 12. Before the sheet P reaches the transfer nip, the sheet P fed from the sheet tray 12 is brought into contact with a timing roller pair 16 and temporarily stopped. After the sheet P is temporarily stopped, the timing roller pair 16 sends out the sheet P to the transfer nip, timed to coincide with the toner image on the photoconductor 6. At the transfer nip, the transferor 11 transfers the toner image on the photoconductor 6 onto the sheet P. After the toner image is transferred from the photoconductors 6 onto the sheet P, the cleaner 10 removes residual toner on the photoconductor 6.

The sheet S bearing the toner image is conveyed to the fixing device 20 and enters the nip between the fixing rotator 21 and the pressure rotator 22. The sheet P is nipped and conveyed by the fixing rotator 21 and the pressure rotator 22, and heat and pressure fixes the toner image on the sheet P onto the sheet P. Subsequently, the output roller pair 14 ejects the sheet P to the output tray 15, and the series of print operations are completed.

Figure 2:
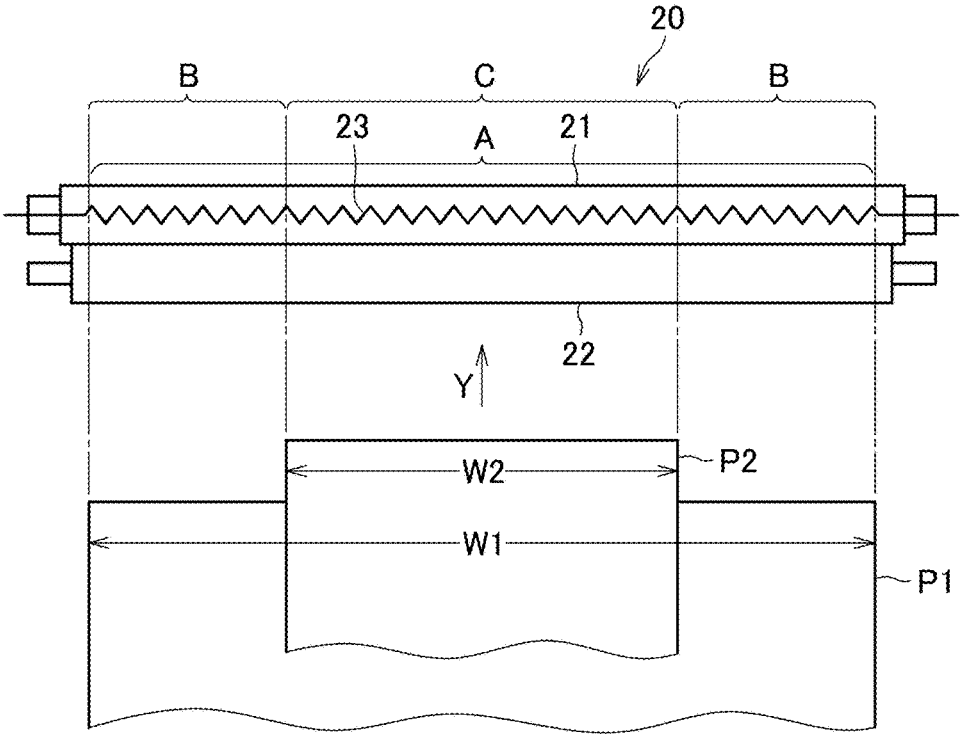
FIG. 2 is a schematic diagram illustrating a sheet-passing region in a fixing device according to the embodiment of the present disclosure.

FIG. 2 is a schematic diagram illustrating a sheet-passing region in the fixing device 20 according to the embodiment of the present disclosure.

As illustrated in FIG. 2, the fixing device 20 according to the present embodiment can convey at least two sizes of sheets P1 and P2 having widths W1 and W2, respectively. In the present embodiment, the fixing device 20 conveys the two sizes of sheets P1 and P2 having different widths but may convey three or more sizes of sheets. In the present embodiment, the width of sheet means a length of sheet in a direction orthogonal to a conveyance direction Y indicated by arrow Y in FIG. 2 or a direction intersecting the conveyance direction. The direction orthogonal to a conveyance direction Y or the direction intersecting the conveyance direction is the same direction as longitudinal directions of the fixing rotator 21 and the pressure rotator 22 and rotation axis directions of fixing rotator 21 and the pressure rotator 22.

The fixing device 20 according to the present embodiment includes a heater 23 disposed over the entire width of a maximum sheet-passing region A (in other words, a maximum recording medium passing region A) through which the sheet P1 having the maximum width W1 passes as illustrated in FIG. 2. Accordingly, the fixing device 20 can favorably perform a fixing process for any size of sheet. The heater 23 in the present embodiment is a halogen heater disposed inside the fixing rotator 21 but may be a radiant heat type heater such as a carbon heater or a ceramic heater. Alternatively, the heater 23 may be an electromagnetic induction heating (IH) type heater. In addition, a heater may be disposed inside the pressure rotator 22 in addition to the heater 23 inside the fixing rotator 21.

Since the heater 23 in the present embodiment is disposed over the entire width of the maximum sheet-passing region A as described above, the heater 23 can uniformly and entirely heat any size of sheet, and the fixing device can favorably perform the fixing process. However, when the sheet P2 having the minimum width W2 smaller than the maximum width W1 of the sheet P1 passes through the fixing device 20, temperature is likely to increase in non-sheet-passing regions B of the fixing rotator 21 and the pressure rotator 22. The non-sheet-passing regions B are outside in a width direction of the sheet P2 from a sheet-passing region C over which the sheet P2 passes. The sheet P2 does not pass over the non-sheet-passing regions B. Therefore, the sheet P2 is less likely to consume heat in the non-sheet-passing regions B, and heat is likely to store in the non-sheet-passing regions B. Continuously passing many sheets having a smaller width than the maximum width through the fixing device remarkably increases temperature in the non-sheet passing regions B. As a result, the temperature of the fixing rotator 21 or the pressure rotator 22 may exceed the heat-resistant temperature. To prevent the temperatures of the fixing rotator 21 and the pressure rotator 22 from increasing in the non-sheet-passing regions B, the fixing section according to the present embodiment includes a blower as a cooling device as follows.

Figure 3:
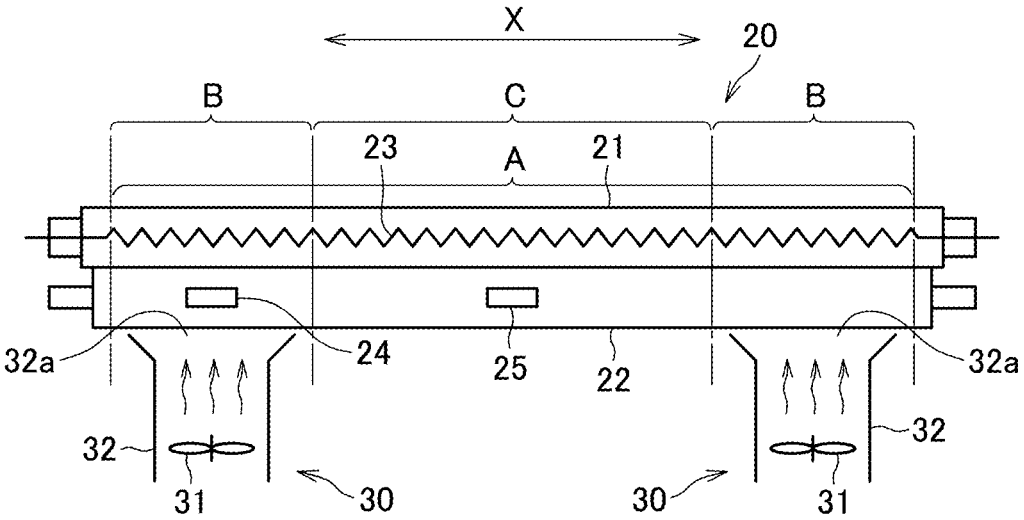
FIG. 3 is a top view of a schematic configuration around blowers.
Figure 4:
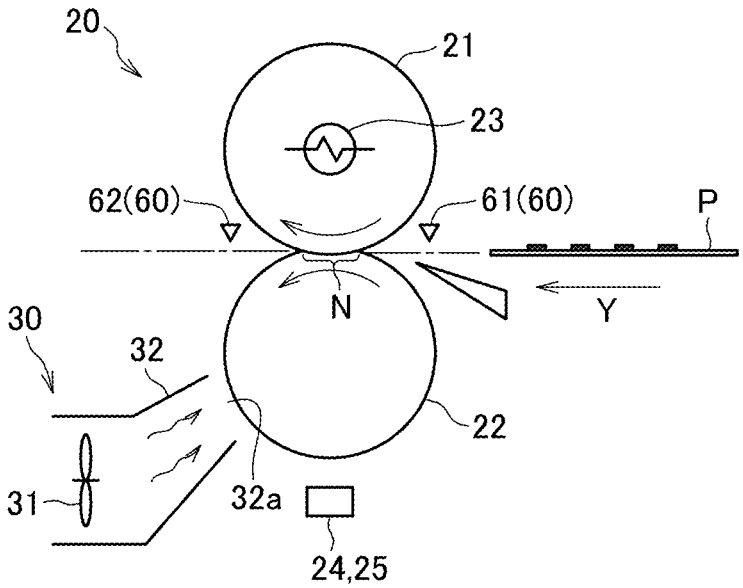
FIG. 4 is a side view of a schematic configuration around blowers.

FIGS. 3 and 4 illustrate a configuration of the blower as the cooling device according to the present embodiment. FIG. 3 is a top view of a schematic configuration around the blowers. FIG. 4 is a side view of the schematic configuration around the blowers.

As illustrated in FIG. 3, blowers 30 in the present embodiment face both ends of the pressure rotator 22 in the longitudinal direction of the pressure rotator 22. Specifically, each blower 30 includes a fan 31 and a duct 32. The fan 31 serves as an airflow generator and generates an airflow. The duct 32 serves as a flow path forming member and guides the airflow from the fan 31 toward the outer peripheral surface of the pressure rotator 22. Each duct 32 has an air blowing port 32*a* disposed opposite or adjacent to the outer peripheral surface of the pressure rotator 22 in the non-sheet-passing region B. Note that the non-sheet passing region B illustrated in FIG. 3 is one example of the non-sheet-passing region. The non-sheet-passing region B is formed when the sheet P2 having a width W2 smaller than the maximum width W1 illustrated in FIG. 2 passes through the fixing device 20. In the case that a plurality of sizes of sheets pass through the fixing device and form a plurality of sizes of non-sheet passing regions, a size and a position of the air blowing port 32*a* in the duct 32 may be appropriately adjusted in accordance with a position and a width of the non-sheet-passing region of the sheet selected.

Since the air blowing port 32*a* in each duct 32 according to the present embodiment is disposed so as to face or be close to the outer peripheral surface of the pressure rotator 22 in the non-sheet-passing region B as described above, rotation of the fan 31 generates the airflow blowing from the air blowing port 32*a* in each duct 32 to the outer peripheral surface of the pressure rotator 22 in the non-sheet-passing region B. The airflow cools the non-sheet-passing region B on the pressure rotator 22. Cooling the non-sheet-passing region B of the pressure rotator 22 also indirectly cools the non-sheet-passing region B on the fixing rotator 21 in contact with the pressure rotator 22. As a result, the above-described configuration prevents the temperature rise in the non-sheet passing region B of each of the fixing rotator 21 and the pressure rotator 22. In particular, as in the example illustrated in FIG. 3, each duct 32 has the air blowing port 32*a* that is formed so as to widen toward downstream of the direction of the airflow. The air blowing port 32*a* having the above-described form enables blowing the airflow over a wide range on the pressure rotator 22 and effectively cooling the non-sheet-passing region. The blower 30 in the present embodiment is disposed downstream from the nip N in the sheet conveyance direction Y to blow air as illustrated in FIG. 4 but may be disposed upstream from the nip N in the sheet conveyance direction Y. Instead of the fan 31 blowing air, a suction fan may be used as the airflow generator.

Generally, when an abnormal state such as a sheet jam or a failure occurs during driving of the image forming apparatus, a controller that is circuitry of the image forming apparatus temporarily stops driving of the image forming apparatus. Specifically, the controller temporarily stops various operations such as an image forming operation in the image forming device, a sheet conveyance operation in the recording medium feeder and the like, a fixing operation in the fixing section, and a sheet ejection operation in the recording medium ejection section even if the various operations are not completed.

After the controller stops the operations, an operator such as a user or a serviceman generally performs a recovery operation. The operator inserts his or her hand into the image forming apparatus to perform the recovery operation, for example, removing a jammed sheet or replacing a component. However, the fixing device and parts around the fixing device may be hot immediately after the controller stops driving of the image forming apparatus and rotating the fixing rotator and the pressure rotator included in the fixing device. For this reason, it is preferable that the fixing device is cooled before the operator starts the recovery operation. However, the above-described image forming apparatus cannot effectively cool the fixing device because the controller stops the driving of the image forming apparatus including the cooling device.

The image forming apparatus according to the present embodiment includes the following control system to effectively cool the fixing device even after the controller stops the driving of the image forming apparatus due to the abnormal state.

Figure 5:
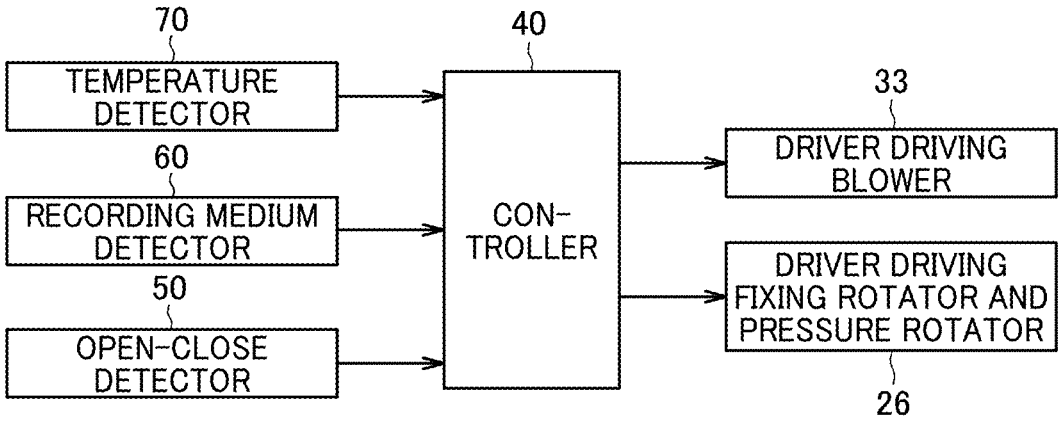
FIG. 5 is a block diagram illustrating a control system of the embodiment.

FIG. 5 is a block diagram illustrating a control system to control the fixing device and the blower according the present embodiment.

As illustrated in FIG. 5, the image forming apparatus according to the present embodiment includes a controller 40 to control a driver 33 that rotates the fan 31 and a driver 26 that rotates the fixing rotator 21 and the pressure rotator 22. The controller 40 is the circuitry such as a microcomputer including a Random Access Memory (RAM) and a Read Only Memory (ROM) and controls not only the driver 33 of the fan 31 and the driver 26 of the fixing rotator 21 and the pressure rotator 22 but also various operations such as an image forming operation in the image forming device, the sheet feeding operation in the recording medium feeder, the fixing operation in the fixing section, and the sheet ejection operation in the recording medium ejection section.

The controller 40 controls starting and stopping an air blowing operation (that is, rotation) of the fan 31. The controller 40 controls a rotation speed of the fan 31 to adjust an air volume blown by the fan 31. The "air volume" is defined as an air volume moved by the fan 31 per unit time, and the air volume Q (m3/h) is represented by a multiplier of a passing air velocity V (m/s) and a passing area A (m2). Specifically, the air volume can be measured using a hot-wire anemometer, a vane anemometer, or the like. The controller 40 also controls a rotation speed of the fixing rotator 21 and the pressure rotator 22 in addition to starting and stopping the rotation of the fixing rotator 21 and the pressure rotator 22.

As illustrated in FIG. 5, the controller 40 controls each of the drivers 33 and 26 based on a temperature detected by a temperature detector 70, a detection signal from a recording medium detector 60, and a detection signal from an open-close detector 50.

The temperature detector 70 includes temperature sensors 24 and 25 facing the non-sheet-passing region B and the sheet-passing region C as illustrated in FIG. 3, respectively. The temperature sensor 24 is disposed the outside of a minimum sheet-passing region (that is, a minimum recording medium passing region) in the width direction and the inside of the maximum sheet-passing region (that is, the maximum recording medium passing region) in the width direction. The temperature sensor 25 is disposed the inside of the minimum sheet passing region in the width direction. In the above, "the inside of a sheet-passing region in the width direction" means a space extending in a direction orthogonal to the width direction indicated by arrow X in FIG. 3 with respect to the sheet-passing region. "The outside of the sheet-passing region in the width direction" means a space outside the space extending in the direction orthogonal to the width direction with respect to the sheet-passing region.

Each of the temperature sensors 24 and 25 is disposed to face the outer circumferential surface of the pressure rotator 22 and not to be in contact with the outer circumferential surface of the pressure rotator 22 (see FIG. 4). The above-described temperature sensors 24 and 25 detect ambient temperatures around the pressure rotator 22. Each of the temperature sensors 24 and 25 may be a contact type temperature sensor that is in contact with the circumferential surface of the pressure rotator 22 to detect the surface temperature of the pressure rotator 22.

The recording medium detector 60 includes a fixing entry sensor 61 and a fixing exit sensor 62 as illustrated in FIG. 4. The fixing entry sensor 61 detects the sheet P in the vicinity of the nip N and upstream from the nip N in the sheet conveyance direction Y, and the fixing exit sensor 62 detects the sheet P in the vicinity of the nip N and downstream from the nip N in the sheet conveyance direction Y. The controller 40 determines whether the sheet P is in the nip N based on a detection signal of at least one of the entry sensor 61 and the exit sensor 62. The controller 40 can determine whether the sheet P has passed through the nip N (that is, whether the sheet P exists in the nip N) based on the length and the conveyance speed of the sheet P and the timing at which at least one of the fixing entry sensor 61 and the fixing exit sensor 62 detects the sheet P. Each of the fixing entry sensor 61 and the fixing exit sensor 62 may be a contact type sensor that contacts the sheet to detect the sheet or a non-contact type sensor that detects the sheet without contacting the sheet.

Figure 6:
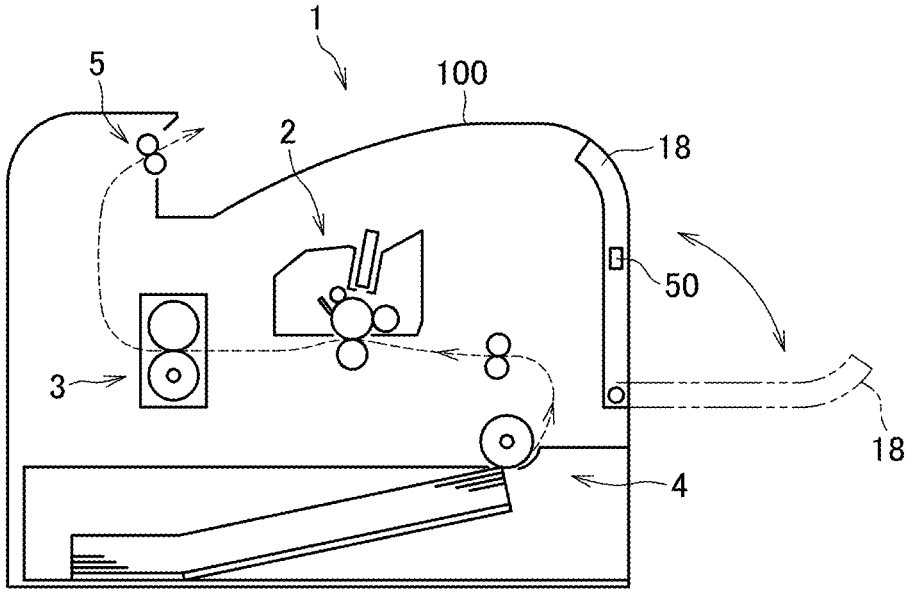
FIG. 6 is a schematic sectional view of the image forming apparatus of FIG. 1 to illustrate a cover disposed on the image forming apparatus and an open-close detector that detects opening and closing the cover.

The open-close detector 50 is a sensor that detects opening and closing of a cover 18 provided on an image forming apparatus main body 100 as illustrated in FIG. 6. The open-close detector 50 is, for example, a transmissive photosensor that outputs a signal in response to transmission of light caused by retracting a light shielding member attached to the cover 18 opened, or a microswitch that detects an operation of an actuator including a spring and a hinge lever. The open-close detector 50 is not limited to a sensor that directly detects opening the cover 18 and may be a sensor that indirectly detects opening the cover 18 by detecting the closed cover 18. In other words, the open-close detector 50 may detect at least one of the open state and the closed state of the cover 18.

Figure 7:
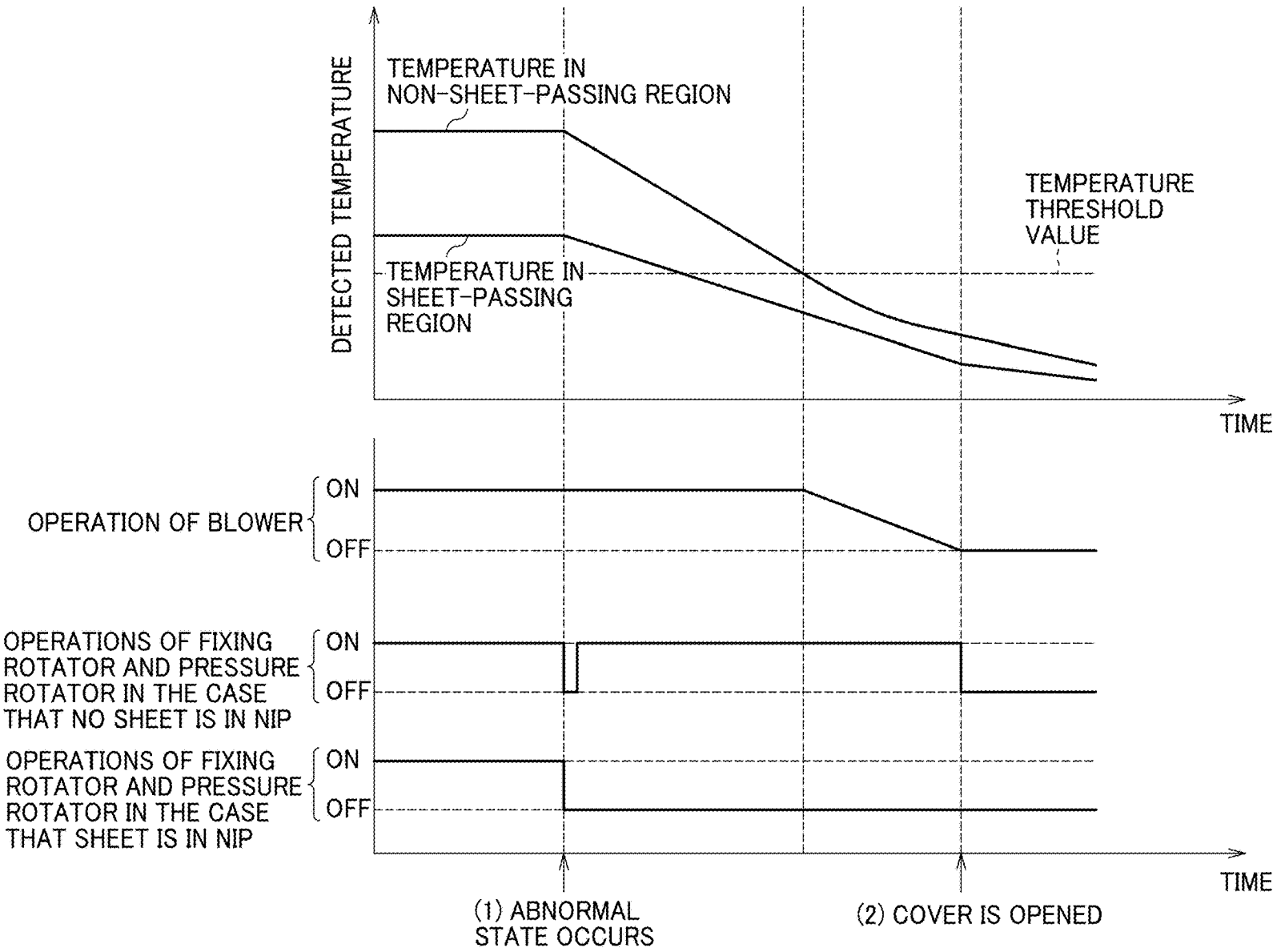
FIG. 7 is a timing chart of operations of the blower and rotators according to a first embodiment of the present disclosure and a graph illustrating temperature change in the fixing device.

FIG. 7 is a timing chart of operations of the blower and rotators in the fixing device, that is, the fixing rotator and the pressure rotator and a graph illustrating temperature change in the fixing device.

The graph in FIG. 7 illustrates a temperature change in the non-sheet-passing region in the fixing device and a temperature change in the sheet-passing region in the fixing device. An upper part of the timing chart in FIG. 7 represents the operation of the blower 30 and the rotation speed of the fan 31. A middle part of the timing chart represents the rotation operation of the fixing rotator and the pressure rotator in the case that no sheet is in the nip. A lower part of the timing chart represents the rotation operation of the fixing rotator and the pressure rotator in the case that the sheet is in the nip. The temperatures of the fixing device detected in the sheet-passing region and the non-sheet-passing region may be the temperature of the pressure rotator 22 or the temperature of the fixing rotator 21.

In FIG. 7, the horizontal axis represents time. Initially, the image forming apparatus normally performs the image forming operation in FIG. 7. FIG. 7 illustrates a timing (1) at which the abnormal state occurs. At the timing, the controller stops the image forming operation. In addition, the controller stops supplying power to the heater in the fixing device and rotating the rotators (that are the fixing rotator and the pressure rotator). FIG. 7 also illustrates a timing (2) at which the open-close detector 50 detects the opening of the cover 18 that is the timing at which the operator opens the cover 18 in the image forming apparatus main body to perform the recovery operation.

Figure 8:
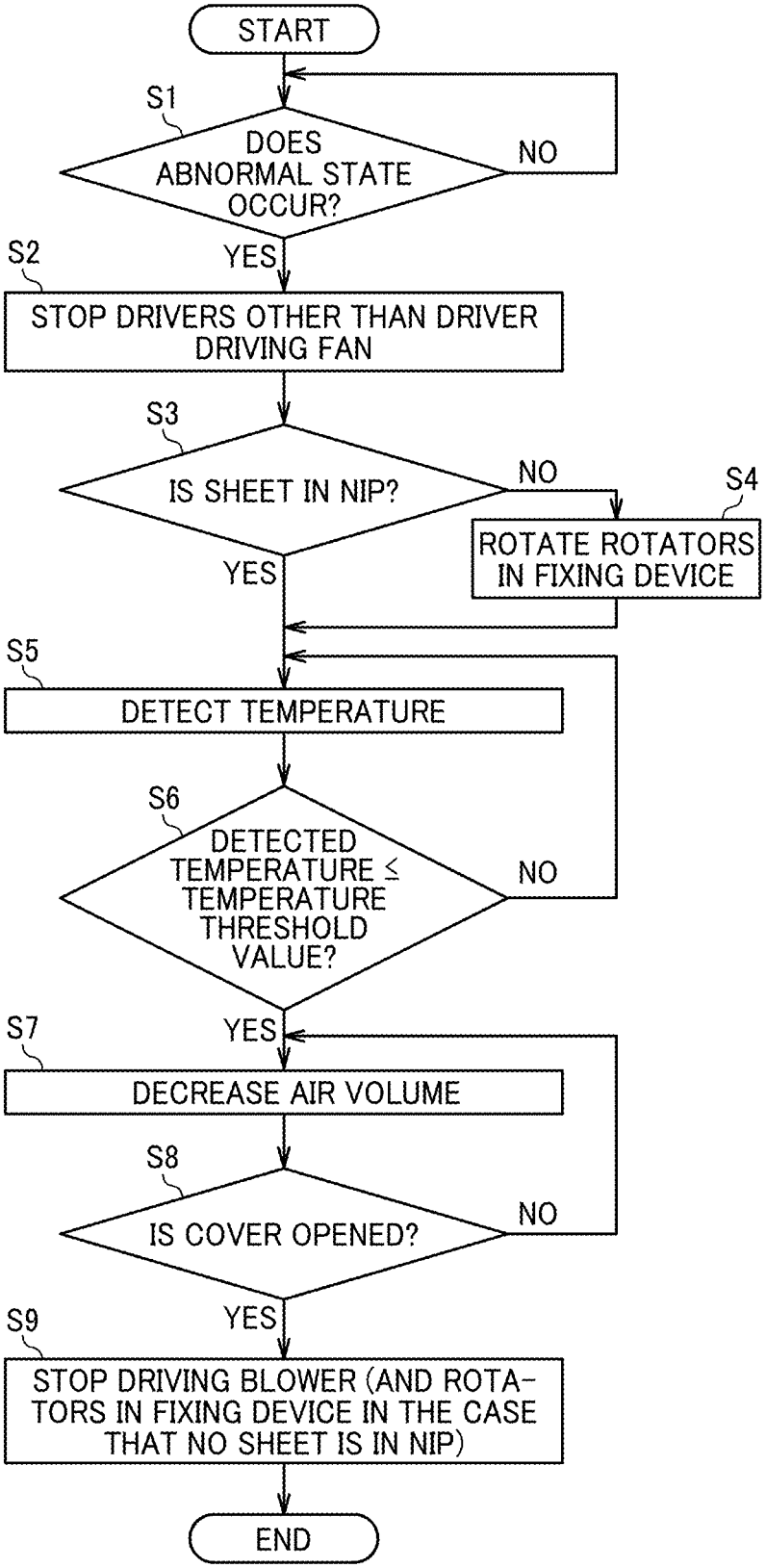
FIG. 8 is a flowchart of operations of the blower and rotators to illustrate a control method of the blower and the rotators according to the first embodiment of the present disclosure.

The following describes a control method according to the first embodiment to control the blower 30 and the fixing device 20 with reference to the timing chart and the graph in FIG. 7 and the flowchart illustrated in FIG. 8.

In response to the occurrence of the abnormal state such as the sheet jam or the failure during driving, the controller in the image forming apparatus according to the first embodiment temporarily stops driving various parts of the image forming apparatus other than the blower and various operations of the image forming apparatus. Specifically, the various operations that is stopped in response to the occurrence of the abnormal state include the image forming operation in the image forming device, the sheet feeding operation in the recording medium feeder, the fixing operation in the fixing section, and the sheet ejection operation in the recording medium ejection section. The fixing operation that is stopped in response to the occurrence of the abnormal state includes rotating the fixing rotator and the pressure rotator in addition to supplying the power to the heater (that is, generating heat in the heater).

The following describes the flowchart illustrated in FIG. 8. When the controller 40 in the image forming apparatus according to the first embodiment detects the occurrence of the abnormal state (YES in step S1 in FIG. 8), the controller 40 stops driving various parts in the image forming apparatus other than the fan 31 (step S2 in FIG. 8). In other words, the controller 40 continues rotating the fan 31 to continue the air blowing operation.

Subsequently, the controller 40 in the image forming apparatus according to the first embodiment determines whether the sheet is in the nip based on the detection signal from the recording medium detector 60 including the fixing entry sensor 61 and the fixing exit sensor 62 in step S3 after the controller detects the occurrence of the abnormal state and stops driving the various parts in step S2. In the case that the controller 40 determines that the sheet is in nip based on the detection signal from the recording medium detector 60 (NO in step S3), the controller 40 controls the driver to start rotating the fixing rotator 21 and the pressure rotator 22 in step S4 of FIG. 8. In this case, the fan 31 continues to blow air while the fixing rotator 21 and the pressure rotator 22 rotate.

On the other hand, in the case that the controller 40 determines that the sheet is in the nip based on the detection signal from the recording medium detector 60 (YES in step S3), the controller 40 does not start rotating the fixing rotator 21 and the pressure rotator 22. In this case, the fan 31 blows air to the fixing rotator 21 and the pressure rotator 22 that are not rotated to cool the fixing rotator 21 and the pressure rotator 22.

Thereafter, the controller 40 controls the temperature detector 70 to detect the temperature in the non-sheet-passing region of the pressure rotator 22 in step S5 and determines whether the detected temperature is equal to or smaller than a temperature threshold value T in step S6. When the detected temperature is equal to or smaller than the temperature threshold value (YES in step S6), the controller 40 controls the driver to decrease the rotation speed of the fan 31 and the air volume (see FIG. 7) in step S7.

Thereafter, the controller 40 continues the air blowing operation of the fan 31 and, when no sheet is in nip, the rotation operation of the fixing rotator 21 and the pressure rotator 22 until the controller determines that the open-close detector 50 detects opening the cover 18 in step S8 of FIG. 8. When the controller 40 determines that the open-close detector 50 detects opening the cover 18 (Yes in step S8), the controller 40 stops the air blowing operation (that is, rotation) of the fan 31 and the rotation operation of the fixing rotator 21 and the pressure rotator 22 in step S9. Thus, the controller completes the control of the blower and the fixing device after the occurrence of the abnormal state.

As described above, the controller 40 of the image forming apparatus according to the first embodiment of the present disclosure continues rotating the fan 31 that is the air blowing operation of the fan 31 to blow the airflow to the non-sheet-passing regions B of the pressure rotator 22 even after the abnormal state occurs and the controller 40 stops the heat generation of the heater 23 in the fixing device 20 and driving the various parts of the image forming apparatus. The above-described control can effectively cool the fixing rotator 21 and the pressure rotator 22 after the controller 40 stops the heat generation of the heater 23 in the fixing device and driving the various parts of the image forming apparatus and improve safety when the operator performs the recovery operation after the abnormal state occurs. In the case that no sheet is in the nip, rotating the fixing rotator 21 and the pressure rotator 22 in addition to the air blowing operation of the fan 31 can more effectively cool the fixing rotator 21 and the pressure rotator 22. In the case that the sheet is in the nip, rotating the fixing rotator 21 and the pressure rotator 22 conveys the sheet, which is temporarily stopped by stopping the sheet conveyance operation in the image forming apparatus, from the fixing device, which may cause a sheet jam. To avoid the sheet jam, the controller stops rotating the fixing rotator 21 and the pressure rotator 22 in the case that the sheet is in the nip.

After the abnormal state occurs and the controller 40 stops the heat generation of the heater 23 and driving the various parts of the image forming apparatus, the rotation speed of the fixing rotator 21 and the pressure rotator 22 is preferably set to be slower than the normal rotation speed of the fixing rotator 21 and the pressure rotator 22 when the sheet passes through the nip in the image forming operation. If the image forming apparatus is designed so that the fixing rotator 21 and the pressure rotator 22 can rotate at a plurality of rotation speeds, it is preferable that the rotation speed of the fixing rotator 21 and the pressure rotator 22 after the abnormal state occurs and the controller 40 stops driving the various parts of the image forming apparatus is set to be slower than the slowest rotation speed among the plurality of rotation speeds in normal operations. During normal printing operations, the fixing rotator 21 and the pressure rotator 22 rotate at a relatively high speed. After the abnormal state occurs and the controller stops driving the various parts in the image forming apparatus, rotating the fixing rotator 21 and the pressure rotator 22 at a similar high speed increases wasteful rotation distances and shortens the life of the fixing device. Accordingly, slowing down the rotation speed of the fixing rotator 21 and the pressure rotator 22 after the abnormal state occurs and the controller stops driving various parts of the image forming apparatus can reduce the wasteful rotation distances and prevent shortening the life of the fixing device.

In addition, the controller in the first embodiment decreases the air volume to improve energy saving when the temperature detected by the temperature detector 70 becomes equal to or lower than a predetermined temperature threshold value T. After the detected temperature is equal to or lower than the predetermined temperature threshold value T, the operator can avoid the risk that the operator contacts a high-temperature portion. Therefore, blowing with a large air volume is not needed. Reducing the air volume can reduce electric power necessary for driving (rotating) the fan 31. The above-described configuration according to the first embodiment can improve the energy saving in addition to improvement in safety.

In the example illustrated in FIG. 7, the controller controls the fan 31 to continuously decrease the air volume at a constant rate after the detected temperature becomes equal to or lower than the temperature threshold value T but may control the fan 31 to decrease the air volume stepwise or intermittently. Decreasing the air volume at the constant rate is not always necessary, and the controller may control the fan 31 to variably reduce the air volume based on the detected temperature. The above-described control of the air volume can be performed not only by changing the rotation speed of the fan 31 but also by changing the opening area of the duct 32 by a shutter or the like.

Next, a second embodiment of the present disclosure is described. Differences from the first embodiment are mainly described below, and descriptions of other parts similar to the first embodiment are omitted below as appropriate.

Figure 9:
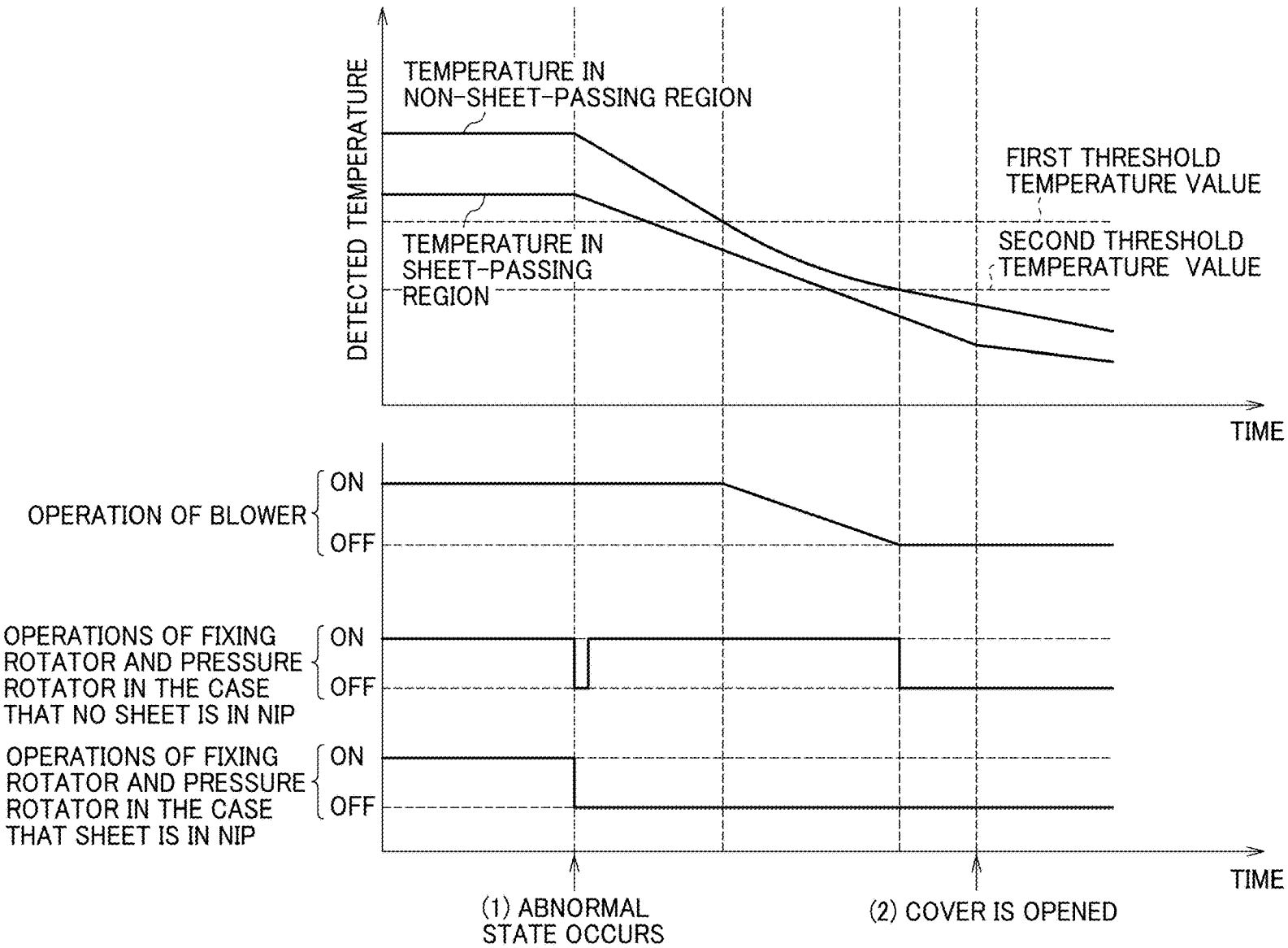
FIG. 9 is a timing chart of operations of the blower and rotators according to a second embodiment of the present disclosure and a graph illustrating temperature change in the fixing device.
Figure 10:
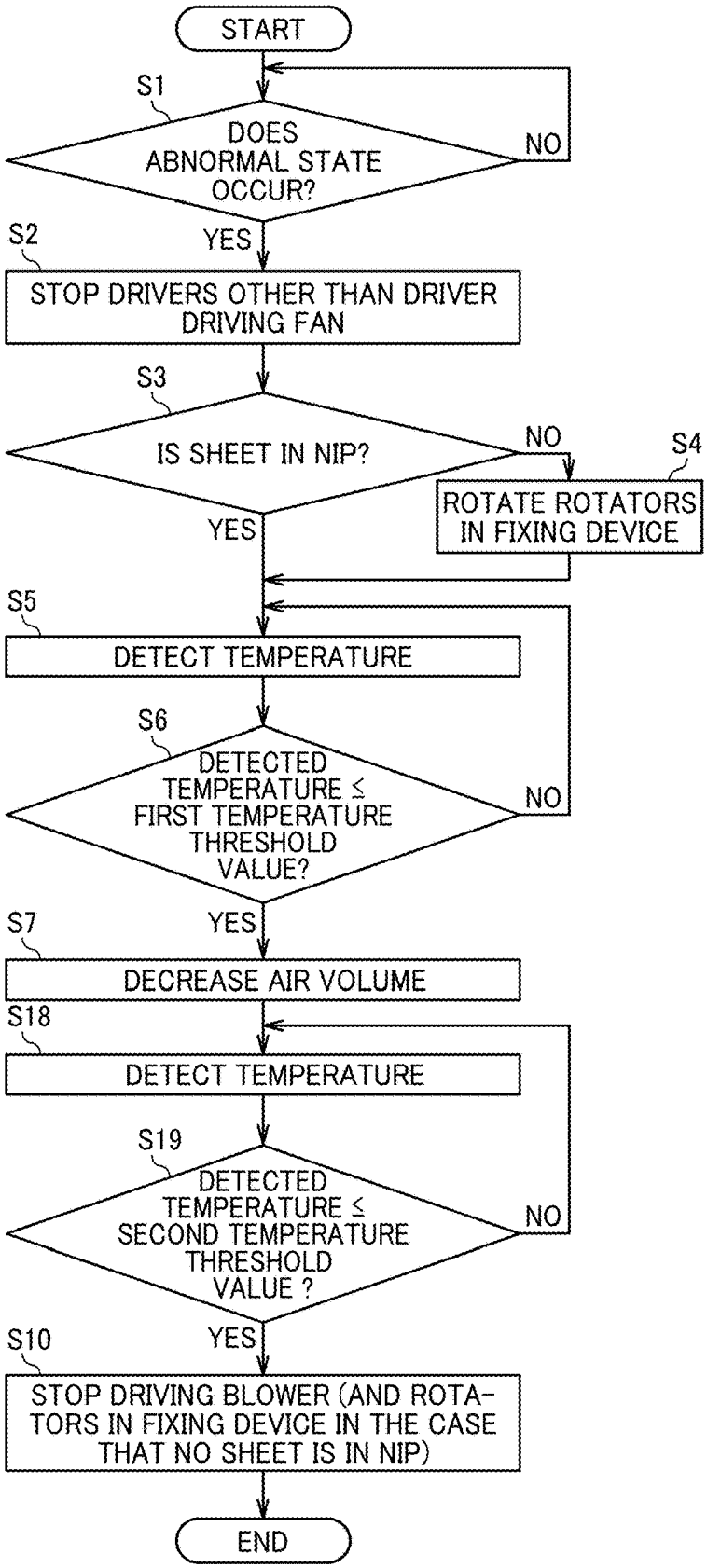
FIG. 10 is a flowchart of operations of the blower and rotators to illustrate a control method of the blower and the rotators according to the second embodiment of the present disclosure.

FIG. 9 is a timing chart of operations of the blower and rotators according to the second embodiment of the present disclosure and a graph illustrating temperature change in the fixing device, and FIG. 10 is a flowchart of operations of the blower and rotators to illustrate a control method of the blower and the rotators according to the second embodiment of the present disclosure.

As illustrated in FIG. 9, two temperature threshold values T1 and T2 are set in advance as temperature threshold values of the detected temperature in the second embodiment of present disclosure. A first temperature threshold value T1 (in other words, a first reference temperature) is the same as the predetermined temperature threshold value in the first embodiment, serving as a reference for the timing at which the air volume of the fan 31 is reduced. A second temperature threshold value T2 (in other words, a second reference temperature and another temperature threshold value) is set to a temperature lower than the first reference temperature, serving as a reference for a timing at which the controller stops the air blowing operation (that is, rotations) of the fan 31 and the rotations of the fixing rotator 21 and the pressure rotator 22. For example, the second temperature threshold value T2 is set to a temperature at which safety can be ensured even if the operator touches the fixing rotator 21 or the pressure rotator 22.

As illustrated by step S1 to step S7 in FIG. 10, the control method in the second embodiment is basically the same as the control method in the first embodiment from the timing at which the abnormal state occurs and the controller stops driving the various parts of the image forming apparatus to the timing of the above-described air volume adjustment of the fan 31 in which the controller controls the fan 31 to reduce the air volume. After the abnormal state occurs and the controller 40 stops the heat generation of the heater 23 in the fixing device and driving the various parts of the image forming apparatus, the controller 40 controls the fan 31 to continue the air blowing operation. In addition, the controller 40 rotates the fixing rotator 21 and the pressure rotator 22 in the case that no sheet is in the nip. Thereafter, the controller 40 controls the fan 31 to reduce the air volume after the temperature detected by the temperature detector 70 becomes equal to or lower than the first temperature threshold value T1.

As illustrated by step S18 in FIG. 10, the controller 40 controls the temperature detector 70 to detect the temperature. Subsequently, the controller determines whether the temperature detected by the temperature detector 70 becomes equal to or lower than the second temperature threshold value T2 in step S19. In the case that the detected temperature becomes equal to or lower than the second temperature threshold value T2 (YES in step S19), the controller 40 stops the air blowing operation (that is, the rotation) of the fan 31 in step S10. In the case that the fixing rotator 21 and the pressure rotator 22 rotate, the controller 40 also stops the rotation operations of the fixing rotator 21 and the pressure rotator 22. Thus, the controller 40 completes a series of control in the second embodiment after the occurrence of the abnormal state. If the open-close detector 50 detects opening the cover 18 before the temperature detected by the temperature detector 70 becomes equal to or lower than the second temperature threshold value T2, the controller 40 in the second embodiment stops the air blowing operation (that is, the rotation) of the fan 31 and the rotation operations of the fixing rotator 21 and the pressure rotator 22 at the timing at which the open-close detector 50 detects opening the cover 18.

As described above, the energy saving in the second embodiment of the present disclosure is further improved by decreasing the air volume when the temperature detected by the temperature detector 70 is equal to or lower than the first temperature threshold value T1 and stopping blowing the air when the detected temperature is equal to or lower than the second temperature threshold value T2. In other words, the controller 40 in the second embodiment stops blowing the air even before the cover 18 is opened in the case that the temperature of the fixing rotator 21 or the pressure rotator 22 decreases to a level at which the air blowing operation is not required (that is the second temperature threshold value T2) to reduce electric for driving (rotating) the fan 31. In addition, stopping the rotations of the fixing rotator 21 and the pressure rotator 22 also reduces the power supplied to the driver driving the fixing rotator 21 and the pressure rotator 22.

Similar to the first embodiment, the controller 40 in the second embodiment compares the temperature detected in the no-sheet-passing region of the pressure rotator 22 with the first and second temperature threshold values T1 and T2 but may compare the temperature detected in the sheet-passing region of the pressure rotator 22, the sheet-passing region of fixing rotator 21, or the non-sheet-passing region of fixing rotator 21 with the first and second temperature threshold values T1 and T2.

Figure 11:
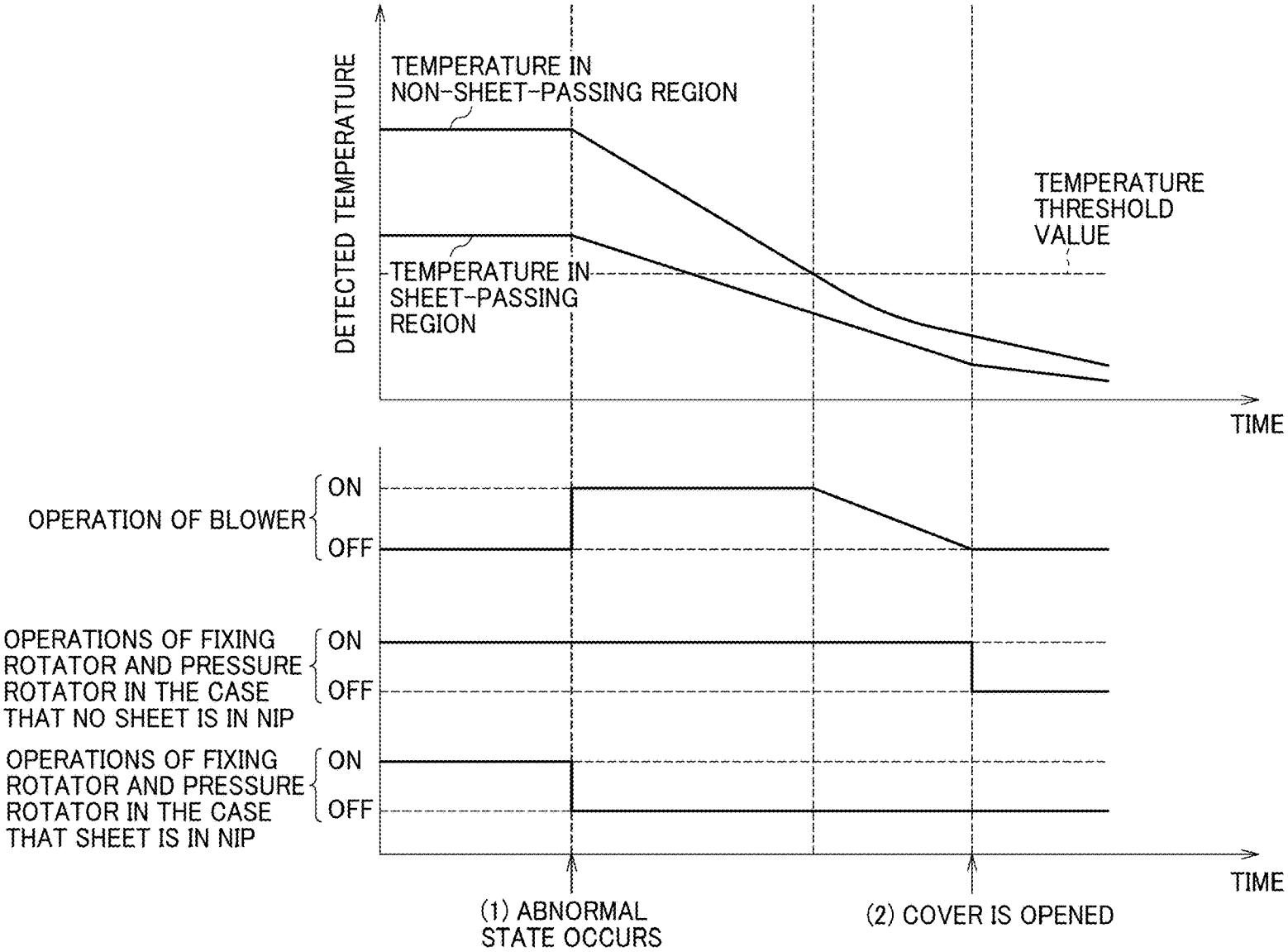
FIG. 11 is a timing chart of operations of the blower and rotators according to a third embodiment of the present disclosure and a graph illustrating temperature change in the fixing device.

Next, a third embodiment of present disclosure is described with reference FIG. 11. In the first and second embodiments, the fan 31 continues to blow air before and after the abnormal state occurs and the controller stops driving various parts of the image forming apparatus (see FIGS. 7 and 9). In the third embodiment, the fan 31 starts to blow air at the time at which the controller stops the various parts of the image forming apparatus or after the time at which the controller stops driving the various parts. In addition, as in the example illustrated in FIG. 11, the controller in the third embodiment continues to rotate the fixing rotator 21 and the pressure rotator 22 without temporarily stopping rotations of the fixing rotator 21 and the pressure rotator 22 in the case that no sheet is in the nip.

Figure 12:
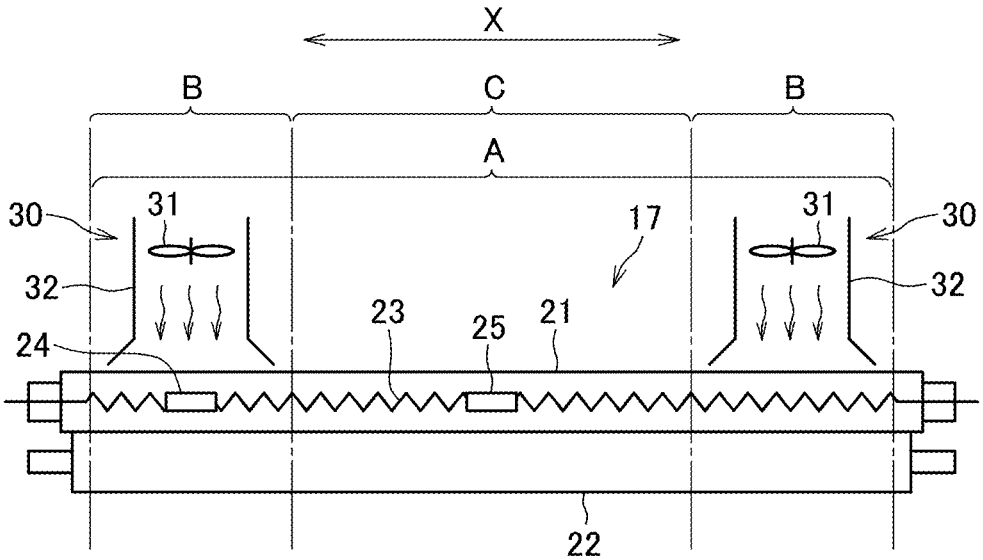
FIG. 12 is a top view of a schematic configuration including the blowers and temperature sensors facing a fixing rotator.

As in the example illustrated in FIG. 12, the blowers 30 and the temperature sensors 24 and 25 may be disposed so as to face the fixing rotator 21 instead of the pressure rotator 22. In this case, the blowers 30 blow air to the outer circumferential surface of the fixing rotator 21 after the abnormal state occurs and the controller stops driving the various parts of the image forming apparatus.

Figure 13:
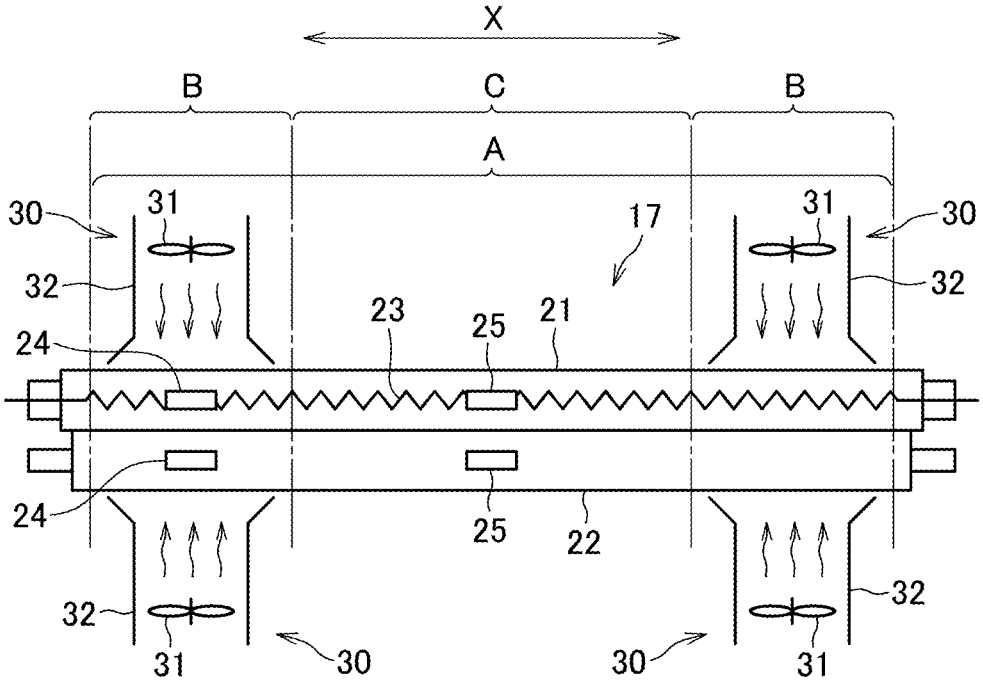
FIG. 13 is a top view of a schematic configuration including the blowers and temperature sensors facing the fixing rotator and other blowers and temperature sensors facing a pressure rotator.

Alternatively, as in the example illustrated in FIG. 13, the blowers 30 and the temperature sensors 24 and 25 may be disposed so as to face both the fixing rotator 21 and the pressure rotator 22.

Figure 14:
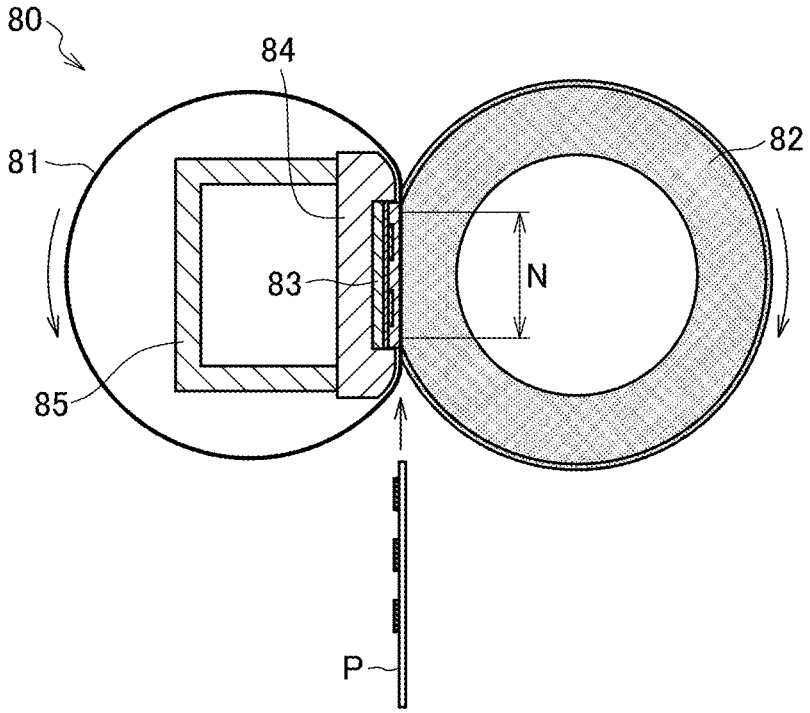
FIG. 14 is a schematic view of a fixing device as a variation of the fixing device of FIG. 2.

The fixing device to which the blowers 30 blow air is not limited to the fixing device as illustrated in FIGS. 3 and 4. For example, the fixing device may include an endless fixing belt 81 as the fixing rotator (a first rotator), a pressure roller 82 as the pressure rotator (a second rotator), a planar heater 83 as the heater, a heater holder 84 as a holding member to hold the heater 83, a stay 85 as a support to support the heater holder 84 as illustrated in FIG. 14. In the above-described configuration, pressing the pressure roller 82 against the heater 83 via the fixing belt 81 forms the nip N between the fixing belt 81 and the pressure roller 82. Applying the present embodiments of the present disclosure to the image forming apparatus including the fixing device 80 described above can effectively cool the fixing belt and the pressure roller.

The present embodiments may be applied the heating device other than the fixing device to cool the heating device. The present embodiments are not limited to the case to cool the fixing device. For example, the present embodiments may be applied to an inkjet type image forming apparatus to cool a dryer as the heating device that heats the sheet to dry liquid such as ink discharged to the sheet.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above. Each of the functions of the described embodiments may be implemented by one or more processing circuits or circuitry. Processing circuitry includes a programmed processor, as a processor includes circuitry. A processing circuit also includes devices such as an application specific integrated circuit (ASIC), a digital signal processor (DSP), a field programmable gate array (FPGA), and conventional circuit components arranged to perform the recited functions.

What is claimed is:

1. An image forming apparatus comprising:

two rotators contacting each other to form a nip through which a recording medium passes;

a driver configured to drive the two rotators;

a heating device including a heater configured to heat at least one of the two rotators;

a blower configured to blow air to the heating device;

a temperature detector configured to detect a temperature of at least one of the two rotators;

a recording medium detector configured to detect whether the recording medium is in the nip;

a cover disposed on an image forming apparatus body and configured to be openable and closable;

an open-close detector configured to detect opening and closing of the cover; and circuitry configured to:

detect an abnormal state and stop heat generation of the heater in response to detection of the abnormal state;

determine whether the cover is closed based on a result detected by the open-close detector, control the blower to blow air to the heating device in response to determining that the cover is closed;

determine whether the recording medium is in the nip based on a result detected by the recording medium detector;

control the driver to rotate the two rotators in response to determining that the cover is closed and determining that no recording medium is in the nip;

determine whether a temperature detected by the temperature detector is equal to or lower than a predetermined temperature threshold value before the open-close detector detects that the cover is opened; and control the blower to decrease an air volume blown by the blower in response to determining that the temperature detected by the temperature detector is equal to or lower than the predetermined temperature threshold value.

2. The image forming apparatus according to claim 1, wherein the circuitry is configured to control the blower to continue blowing air and the driver to continue rotating the two rotators until the circuitry determines that the cover is opened based on a result detected by the open-close detector, and wherein the circuitry is configured to control the blower to stop blowing air and the driver to stop rotating the two rotators in response to determining that the cover is opened based on a result detected by the open-close detector.

3. The image forming apparatus according to claim 1, wherein the circuitry is configured to:

determine whether a temperature detected by the temperature detector is equal to or lower than another predetermined temperature threshold value that is smaller than the predetermined temperature threshold value before the open-close detector detects that the cover is opened; and control the blower to stop blowing air and the driver to stop rotating the two rotators in response to determining that the temperature detected by the temperature detector is equal to or lower than said another predetermined temperature threshold value.

4. The image forming apparatus according to claim 1, wherein the driver is configured to rotate the two rotators at a rotation speed after the circuitry stops the heat generation of the heater in response to the detection of the abnormal state, and the rotation speed is slower than a rotation speed of the two rotators when the recording medium passes through the nip before the circuitry detects the abnormal state.

5. The image forming apparatus according to claim 1, wherein the blower is configured to blow air to at least one of the two rotators outside a minimum recording medium passing region in a width direction of the recording medium.

6. The image forming apparatus according to claim 1, wherein the temperature detector is configured to detect a temperature of at least one of the two rotators outside a minimum recording medium passing region in a width direction of the recording medium.

7. The image forming apparatus according to claim 1, further comprising a fixing device including the heating device and the two rotators.

* * * * *